US010886654B2

(12) United States Patent
Pan et al.

(10) Patent No.: US 10,886,654 B2
(45) Date of Patent: Jan. 5, 2021

(54) CONNECTOR AND CONNECTOR HOUSING

(71) Applicants: Tyco Electronics (Shanghai) Co. Ltd., Shanghai (CN); TE Connectivity India Private Limited, Bangalore (IN)

(72) Inventors: Lei Pan, Shanghai (CN); Pai Rajendra, Bangalore (IN); Tongbao Ding, Shanghai (CN)

(73) Assignees: Tyco Electronics (Shanghai) Co. Ltd., Shanghai (CN); TE Connectivity India Private Limited, Bangalore (IN)

( * ) Notice: Subject to any disclaimer, the term of this patent is extended or adjusted under 35 U.S.C. 154(b) by 0 days.

(21) Appl. No.: 16/426,466

(22) Filed: May 30, 2019

(65) Prior Publication Data

US 2019/0372261 A1 Dec. 5, 2019

(30) Foreign Application Priority Data

Jun. 1, 2018 (CN) ..... 2018 2 0848708 U
Jul. 23, 2018 (CN) ..... 2018 2 1172020 U

(51) Int. Cl.
*H01R 13/41* (2006.01)
*H01R 4/18* (2006.01)

(52) U.S. Cl.
CPC ..... *H01R 13/41* (2013.01); *H01R 4/185* (2013.01)

(58) Field of Classification Search
CPC .... H01R 13/41; H01R 13/113; H01R 13/055; H01R 4/185
See application file for complete search history.

(56) References Cited

U.S. PATENT DOCUMENTS 3,555,493 A * 1/1971 Baumanis ..... H01R 12/721 439/636
3,720,907 A * 3/1973 Asick ..... H01R 13/428 439/636
3,781,760 A * 12/1973 Mancini ..... H01R 13/4223 439/595
4,214,361 A * 7/1980 Coldren ..... H01R 43/20 29/863
4,220,388 A * 9/1980 Dechelette ..... H01R 13/115 439/268
5,554,054 A * 9/1996 Bratina ..... H01R 13/428 439/730
5,626,499 A * 5/1997 Yagi ..... H01R 13/4223 439/595
5,980,330 A * 11/1999 Veselaski ..... H01R 13/432 439/733.1
7,198,526 B1 * 4/2007 MacNeil ..... H01R 4/185 439/881
7,462,080 B2 * 12/2008 Shiraishi ..... H01R 13/113 439/852
9,692,163 B1 * 6/2017 Didonato ..... H01R 13/4223
10,079,440 B1 * 9/2018 Didonato ..... H01R 13/115
10,181,673 B1 * 1/2019 Hemnani ..... H01R 13/502

* cited by examiner

*Primary Examiner* — Briggitte R. Hammond
(74) *Attorney, Agent, or Firm* — Barley Snyder

(57) ABSTRACT

A connector having a housing having a receiving passage formed therein. A terminal inserted in an insertion direction and mounted in the receiving passage. Wherein a limiting protrusion is on a wall of the receiving passage, and configured to be abutted against the terminal retaining a portion of the terminal outside the receiving passage, when the terminal is pre-inserted into the receiving passage.

20 Claims, 8 Drawing Sheets

CONNECTOR AND CONNECTOR HOUSING

CROSS-REFERENCE TO RELATED APPLICATION

This application claims the benefit of the filling date under 35 U.S.C. § 119(a)-(d) of Chinese Patent Application No. 201820848708.6 filed on Jun. 1, 2018 and No. 201821172020.7 filed on Jul. 23, 2018.

FIELD OF THE INVENTION

The present invention relates, in general, to electrical connectors and to elelctical connector housings and more particularly to a connector and a connector housing which can be automatically assembled.

BACKGROUND

In the related art, connectors are widely used in industrial and home appliances. Generally, when connectors are used, it is often necessary for an operator to crimp a wire onto a terminal and then fully insert the terminal crimped with the wire into the housing so as to form the assembled connector. When a large number of connectors are required, it takes a long time to assemble the connectors due to the manual assembly process, this results in high labor cost, and in turn means a demand for a large number of connectors cannot be satisfied.

SUMMARY

A connector according to the present invention, generally comprises a housing having a receiving passage formed therein. A terminal is inserted in an insertion direction and mounted in the receiving passage; and a limiting protrusion is on a wall of the receiving passage, and configured to be abutted against the terminal retaining a portion of the terminal outside the receiving passage, when the terminal is pre-inserted into the receiving passage.

According to another general concept of the present invention, a connector housing generally comprises a receiving passage configured to receive a terminal inserted in an insertion direction and mounted therein. A limiting protrusion is on a wall of the receiving passage, and configured to be abutted against the terminal when the terminal is pre-inserted into the connector housing so as to retain a portion of the terminal outside the connector housing.

BRIEF DESCRIPTION OF THE DRAWINGS

The invention will now be described by way of example with reference to the accompanying Figures, of which.

DETAILED DESCRIPTION OF EMBODIMENT(S)

Figure 1:
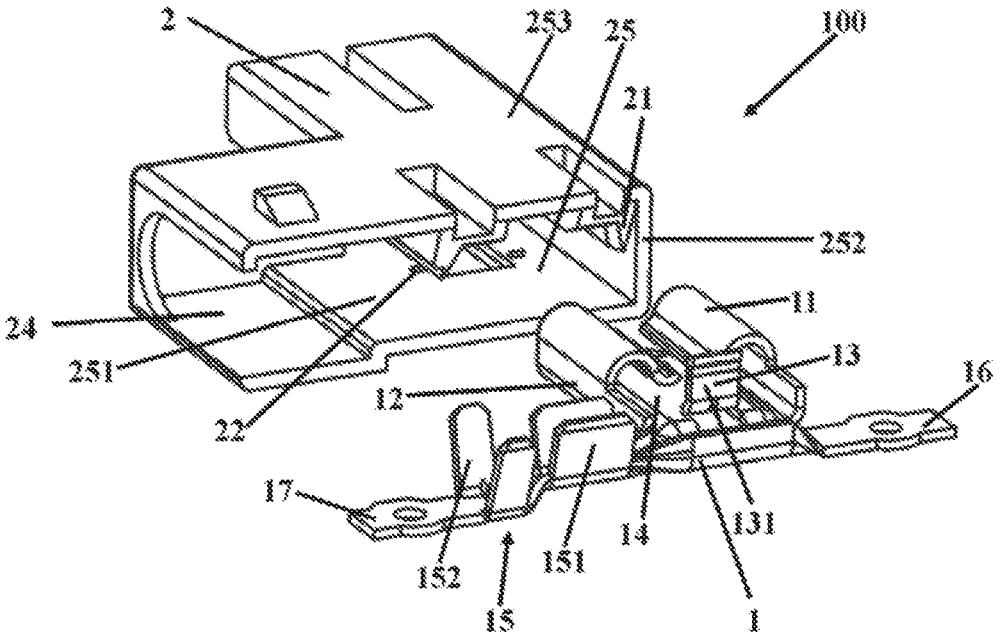
FIG. 1 is an exploded perspective view of a connector according to an embodiment.

Embodiments of the present disclosure will be described hereinafter in detail with reference to the attached drawings, wherein like reference numerals refer to like elements. The present invention may, however, be embodied in many different forms and should not be construed as being limited to the embodiment set forth herein; rather, these embodiments are provided so that the present disclosure will convey the concept of the invention to those skilled in the art.

The connector 100, as shown in FIGS. 1-4, includes: a terminal 1 configured to electrically connect a wire and a housing 2 configured to receive the terminal 1.

A receiving passage 25 is formed in the housing 2, and configured to receive the terminal 1 inserted into the housing 2 in an insertion direction and mounted therein. In an exemplary embodiment, at least one limiting protrusion 22 is disposed on a wall of the receiving passage 25, and is configured to abut against the terminal 1 to prevent the terminal 1 from being further inserted when the terminal 1 is pre-inserted into the receiving passage 25 of the housing 2, so as to retain a portion of the terminal 1 outside the receiving passage 25 of the housing 2, thereby facilitating crimping the wire onto the portion of the terminal 1 which is retained outside the receiving passage 25 of the housing 2.

When the terminal 1 is fully inserted into the housing 2, the limiting protrusion 22 is scraped off by a front end of the terminal 1 so as to allow a crimping portion 15 of the terminal to be further inserted into the housing 2. In this way, the terminal 1 is completely inserted and mounted in the housing passage 25.

The terminal 1 includes: a body portion 12; two fixed arms 11 extending upward from two opposite sides of the body portion 12 toward an upper side of the body portion 12 so as to fix a mating terminal (not shown) inserted from the front end of the terminal 1 between the body portion 12 and the fixed arm 11; and the crimping portion 15 is connected to a rear end of the body portion 12 and adapted to crimp the wire thereon. In an embodiment, the crimping portion 15 includes two oppositely disposed wire core crimping pieces 151 and two oppositely disposed wire insulation crimping pieces 152. The wire core crimping pieces 151 are used for crimping a core of the wire, and the wire insulation crimping pieces 152 are used for crimping an insulation layer of the wire.

According to an exemplary embodiment, one or more limiting protrusions 22 may be disposed on any one or all of a bottom wall 251, a side wall 252 and a top wall 253 of the receiving passage 25 as necessary. For example, two limiting protrusions 22 are shown formed on the bottom wall 251 of the receiving passage 25.

In another exemplary embodiment, the crimping portion 15 of the terminal 1 extends outwards in a direction perpendicular to the insertion direction from one side of the body portion 12 such that the terminal 1 has a substantially "L" shape in a plan view.

In order to receive the terminal 1 in the form of a "L" shape, the housing 2 is further formed with an auxiliary receiving portion 24 extending in a direction perpendicular to the insertion direction at a rear end of the receiving passage 25 and the auxiliary receiving portion communicates with the receiving passage 25, such that the housing 2 is in the form of a "L" shape so as to receive the crimping portion 15 of the terminal 1 in the form of a "L" shape when the terminal 1 is fully inserted into the housing 2.

In another exemplary embodiment, a positioning portion 21 extending in the insertion direction is provided on the top wall 253 of the receiving passage 25, and is configured to guide the fixed arm 11 of the terminal 1 to insert into the receiving passage 25 and position the fixed arm 11 therein when the terminal 1 is pre-inserted into the housing 2, so as to prevent the pre-inserted terminal 1 from being disengaged from the housing 2 due to poor fixing thereof during the process of transferring the connector 100 from a production line to an automatic crimping apparatus.

Figure 3:
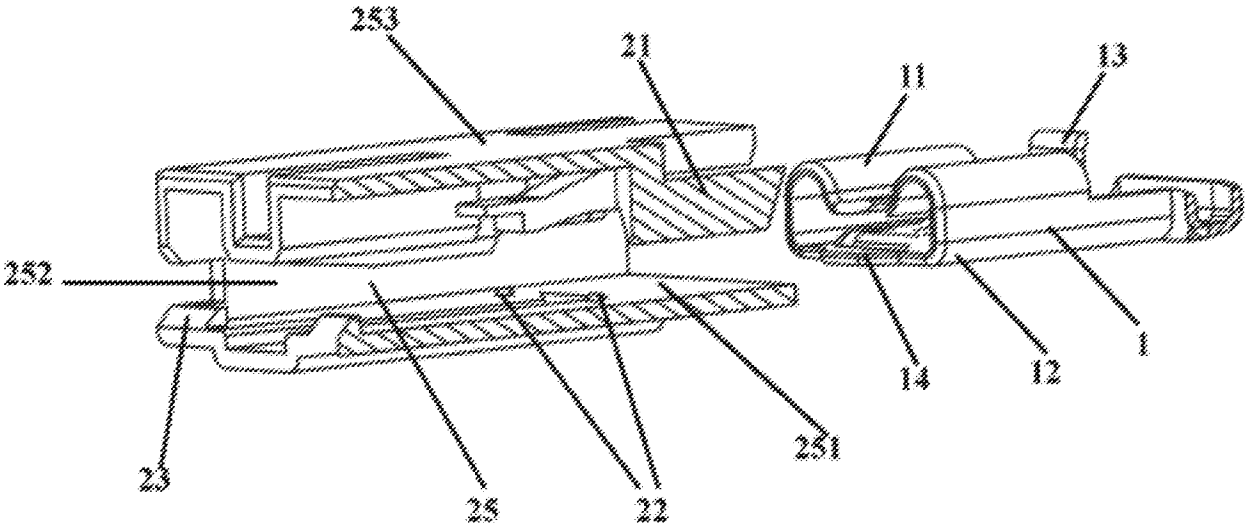
FIG. 3 is a cross-sectional view of the connector of FIG. 1.
Figure 4:
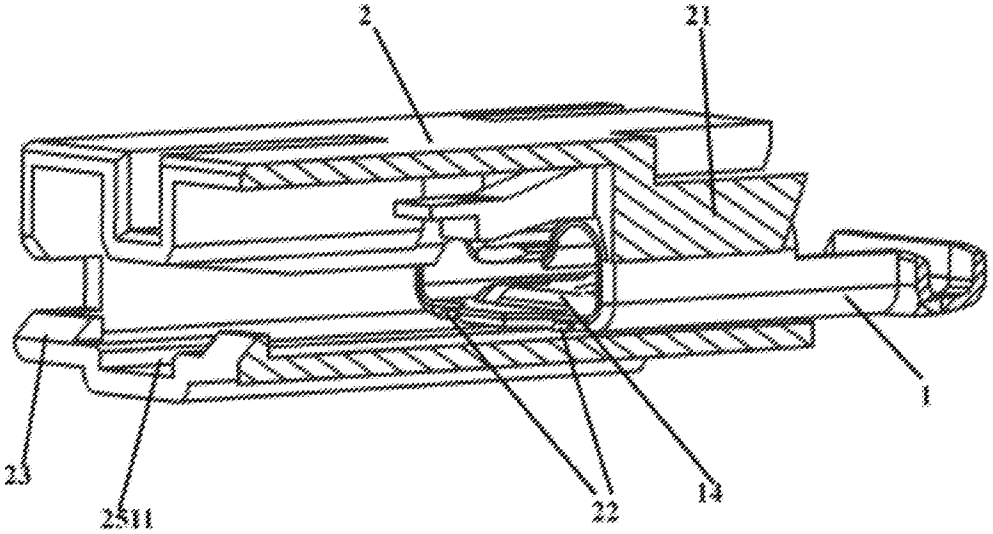
FIG. 4 is a cross-sectional view of the connector of FIG. 2.

As shown in an exemplary embodiment in FIGS. 1, 3-4, the limiting protrusion 22 is located on the bottom wall 251 of the receiving passage 25.

A guiding slot 2511 extending in the insertion direction is provided on the bottom wall 251 of the receiving passage 25, as shown in an exemplary embodiment, so as to guide a protruding-downwardly portion (not shown) of the bottom wall 14 of the terminal 1. In this way, the protruding-downwardly portion abuts against a first protruding wall (not shown) of the guiding slot 2511 when the terminal 1 is fully inserted into the receiving passage 25, so as to assist in positioning the terminal 1 therein.

Figure 8:
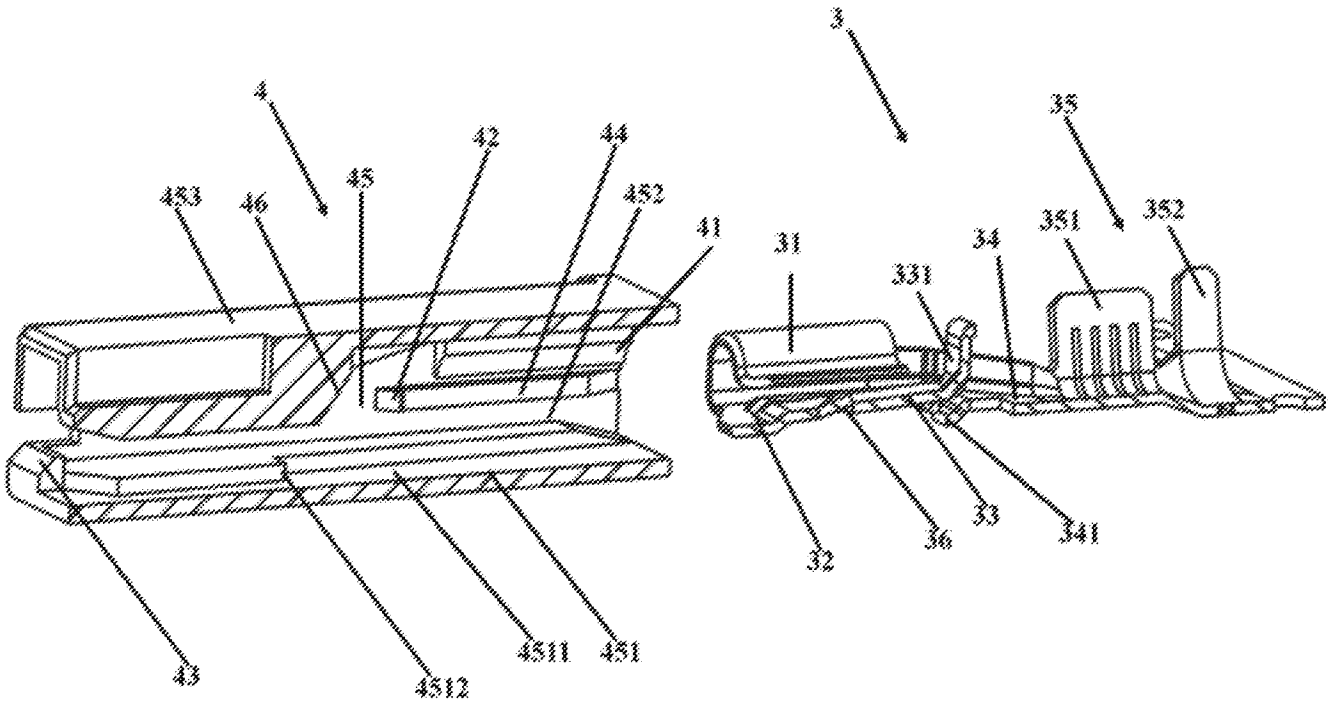
FIG. 8 is a cross-sectional view of the connector of FIG. 5.
Figure 9:
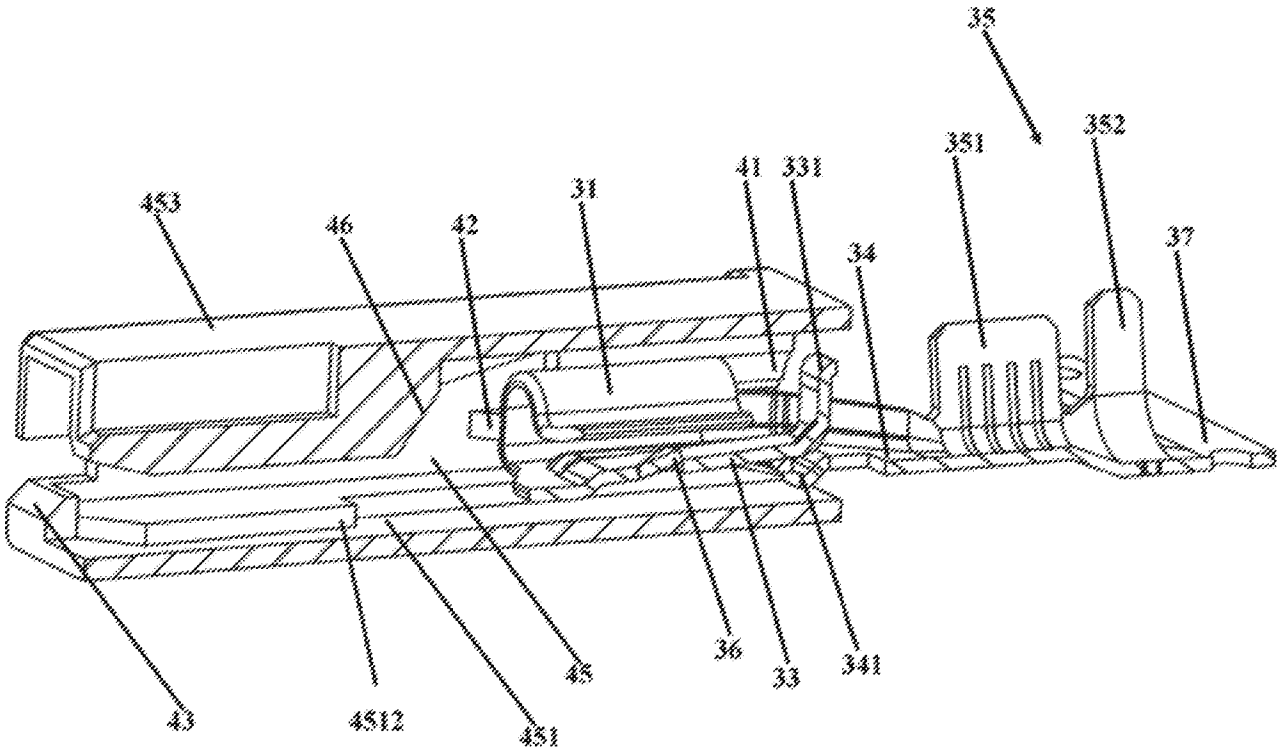
FIG. 9 is a cross-sectional view of the connector of FIG. 6.
Figure 10:
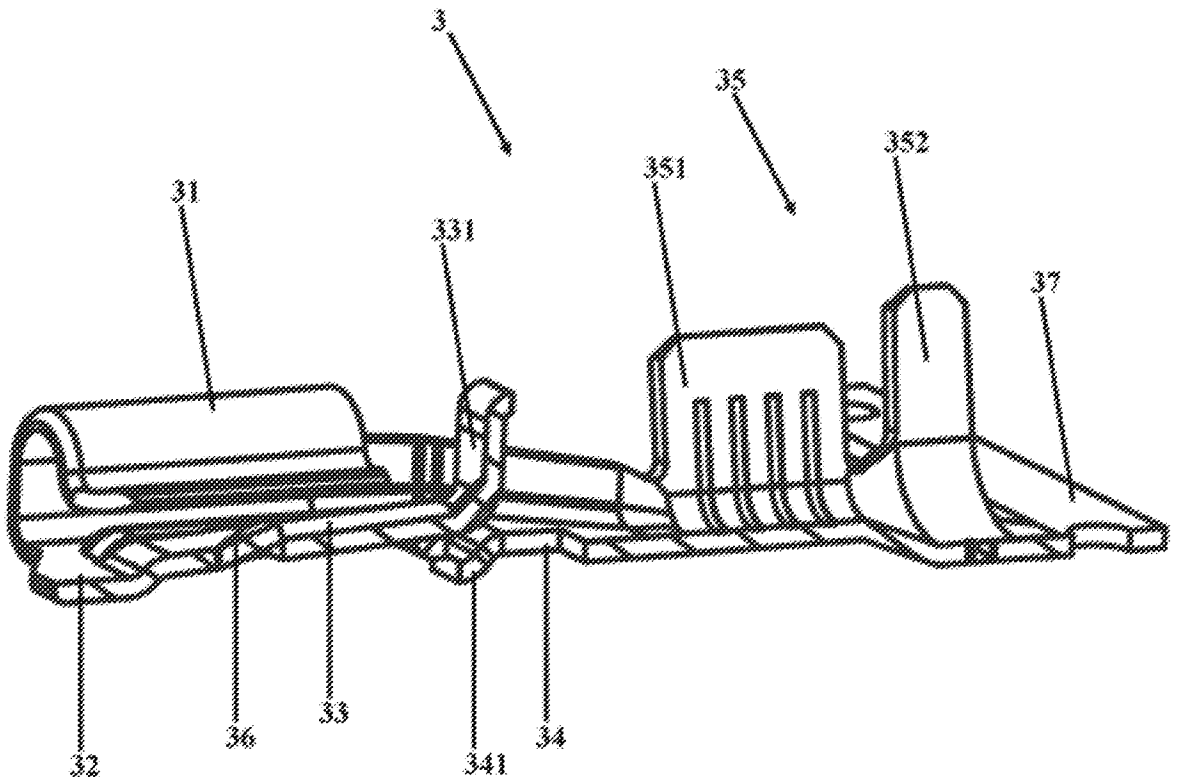
FIG. 10 is a cross-sectional view of a terminal in the connector of FIG. 9.

As shown in an exemplary embodiment in FIGS. 1 and 2 and referring to FIG. 8 which will be described hereafter, the terminal 1 further includes a release arm 13 extending obliquely upward from the bottom wall 14 of the terminal 1 in a direction opposite to the insertion direction, and has a rear end bent upward as a driving portion 131, which abuts against a portion of the housing 2 when the terminal 1 is fully inserted into the receiving passage 25. In the case where the mating terminal is inserted into the terminal 1, in order to release the mating terminal, the housing 2 is moved backward relative to the fully inserted terminal 1, and thus the driving portion 131 is depressed by the housing 2, so that the inserted mating terminal is allowed to be released from the terminal.

In an exemplary embodiment, the terminal 1 further includes: a fixing protrusion 36 formed on the release arm 13 and configured to be cooperated with a fixing hole (not shown) of the mating terminal when the mating terminal is inserted into the terminal 1, so as to lock the mating terminal lock between the body portion 12 and the fixed arm 11.

Further, according to an example embodiment, the housing 2 further includes: a sloped wall (not shown) extending downward from the top wall 253 of the receiving passage 25, and is adapted to drive the driving portion 131 downward when the housing 2 moves rearward relative to the fully inserted terminal 1, so that the fixing protrusion 36 is disengaged from the fixing hole, thereby releasing the inserted mating terminal.

Accordingly, the housing 2, in an exemplary embodiment, further includes: a blocking protrusion 23 formed at the front end of the housing 2, so as to prevent the terminal 1 from being inserted further when the terminal 1 is completely inserted the housing 1.

The terminal 1 further has strips 16, 17 having an end 16 and an opposite end 17 respectively located at a front end and/or a rear end of the crimping portion 15, through which a plurality of the terminals 1 may be successively connected in a row when the terminals 1 are processed.

During manufacturing the connector, a row of the terminals 1 are pre-inserted into the plurality of housings 2 respectively on the production line, so as to form a row of pre-inserted connectors 100 with the terminals 1; then the row of pre-inserted connectors 100 is installed in an automatic crimping device. The automatic crimping device is controlled to first crimp a wire into the crimping portion 15 of any one of the terminals 1, and then fully insert the terminal 1 crimped with the wire into the housing 2, so as to form the assembled connector 100. The strips 16, 17 are cut off therefrom when the assembled connector 100 is used. This eliminates steps of manual crimping of the wires and manual insertion of the connector 100, and operation of assembling the connector 100 may be automatically, reducing assembly time and labor assembly costs of the connector.

In an exemplary embodiment, shown in FIGS. 5-10, the connector 200 includes: a terminal 3 configured to electrically connect a wire and a housing 4 configured to receive the terminal 3.

A receiving passage 45 is formed in the housing 4, and configured to receive the terminal 3, inserted into the housing 4, in an insertion direction and mounted therein. In an embodiment, at least one limiting protrusion 42 is disposed on a wall of the receiving passage 45, and is configured to be abutted against the terminal 3 to prevent the terminal 3 from being further inserted when the terminal 3 is pre-inserted into the receiving passage 45 of the housing 4, so as to retain a portion of the terminal 3 outside the receiving passage 45 of the housing 4, thereby facilitating crimping the wire onto the portion of the terminal 1 which is retained outside the receiving passage 25 of the housing 2.

When the terminal 3 is fully inserted into the housing 4, the limiting protrusion 42 is scraped off by a front end of the terminal 3 so as to allow the crimping portion 35 of the terminal 3 to be further inserted into the housing 4. In this way, the terminal 3 is completely inserted and mounted in the receiving passage 45.

The terminal 3 includes: a body portion 32; two fixed arms 31, extending upward from two opposite sides of the body portion 32, toward an upper side of the body portion 32, so as to fix a mating terminal (not shown) inserted from the front end of the terminal 3 between the body portion 32 and the fixed arm 31; and a crimping portion 35 is connected to a rear end of the body portion 32 and adapted to crimp the wire thereon. In an embodiment, the crimping portion 35 includes two oppositely disposed wire core crimping pieces 351 and two oppositely disposed wire insulation crimping pieces 352. The wire core crimping pieces 351 are used for crimping a core of the wire, and the wire insulation crimping pieces 352 are used for crimping an insulation layer of the wire.

In an exemplary embodiment, one or more of the limiting protrusions 42 may be disposed on any one or all of the bottom wall 451, the side wall 452 and the top wall 453 of the receiving passage 45, as necessary.

According to an exemplary embodiment, unlike the terminal 1 which is in the form of a "L" shape, here a crimping portion 35 of the terminal 3 extends in a direction opposite to the insertion direction, so that the terminal 3 has a substantially "straight line" shape in a plan view.

Figure 2:
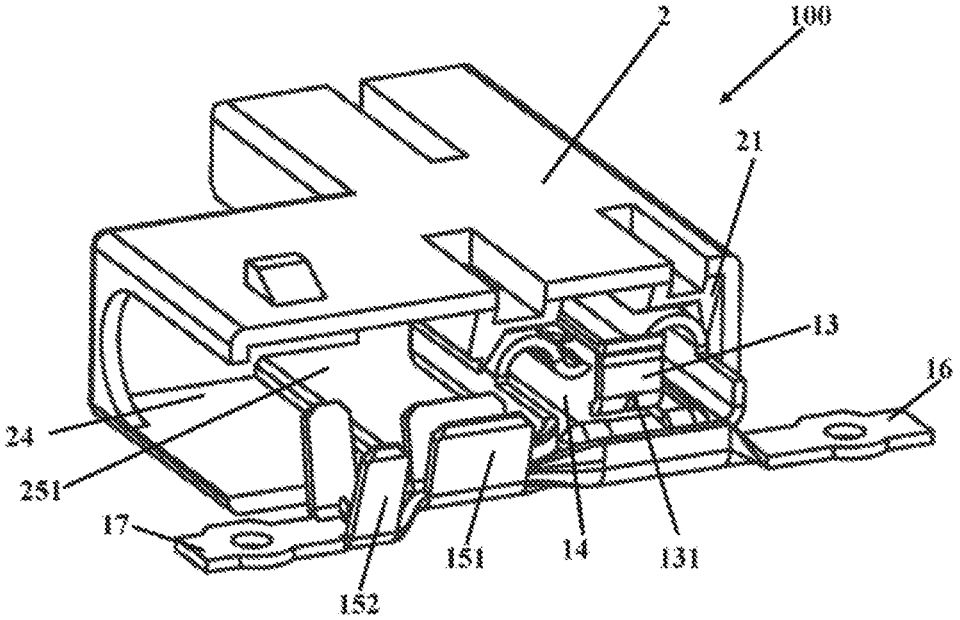
FIG. 2 is a perspective view of the connector of FIG. 1.
Figure 5:
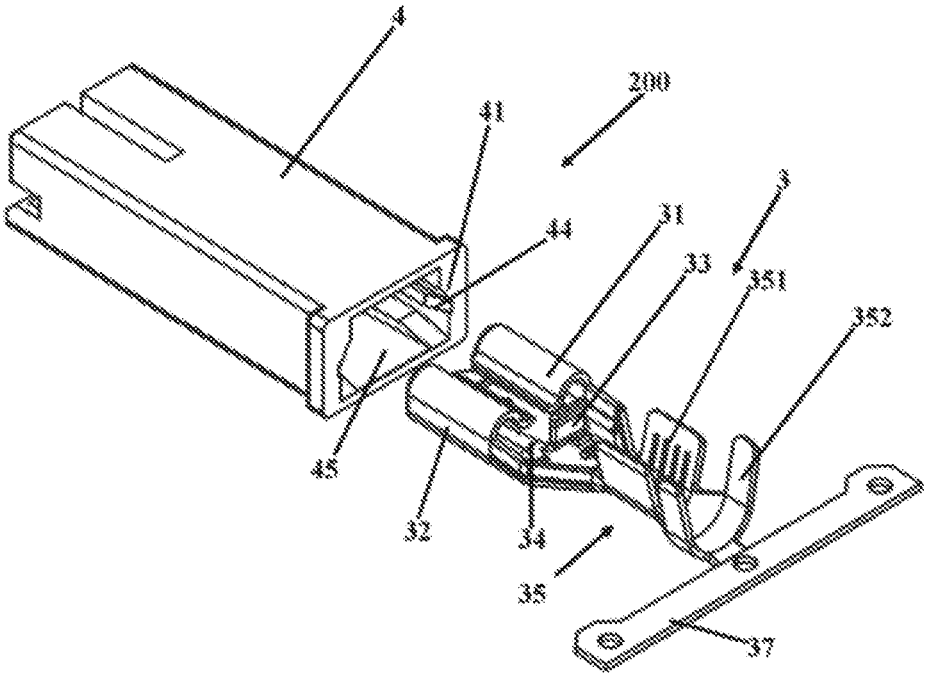
FIG. 5 is an exploded perspective view of a connector according to an embodiment.
Figure 6:
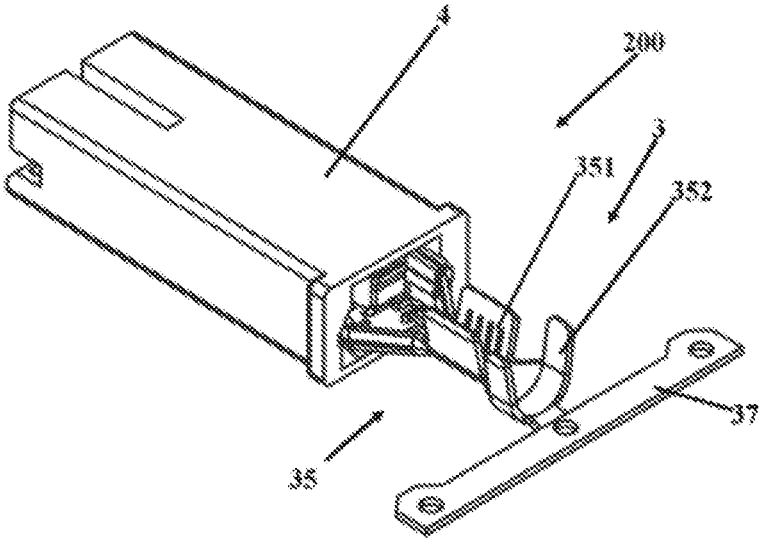
FIG. 6 is a perspective view of the connector of FIG. 5.
Figure 7:
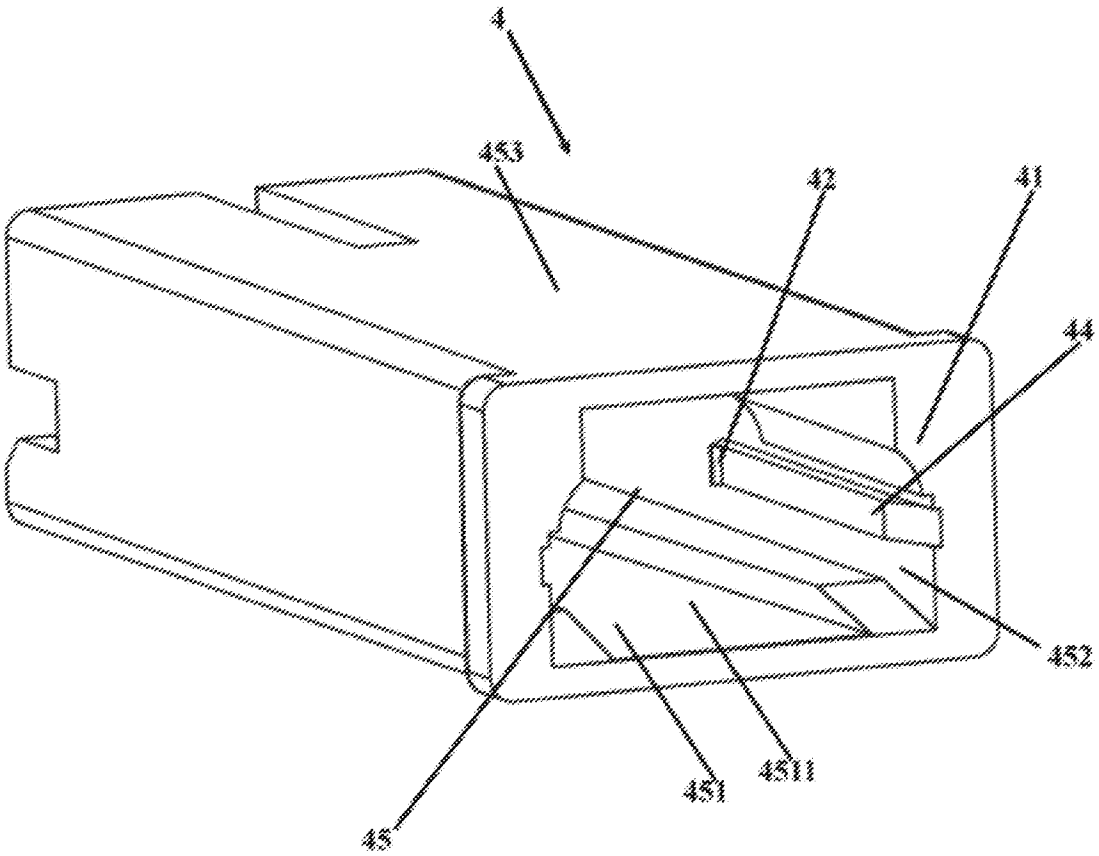
FIG. 7 is a perspective view of a connector housing of the connector of FIG. 5.

In order to receive the terminal 3 in the form of the "straight line" shape, dissimilar to the housing 2, the housing 4 does not have the auxiliary receiving portion 24 as shown in FIGS. 1 and 2. As shown in FIGS. 5 and 6, the receiving passage 45 of the housing 4 is in the form of the "straight" shape to receive the crimping portion 35 when the terminal 3 is fully inserted into the housing 4.

Optionally, an auxiliary receiving portion may be provided in the housing 4, such that the auxiliary receiving portion of the housing 4 extends in a direction opposite to the insertion direction at the rear end of the receiving passage 45, and communicates with the receiving passage 45 to receive the crimping portion 35 of the terminal 3.

Further, according to an embodiment, the limiting protrusion 42 is disposed on the side wall 452 of the receiving passage 45.

Likewise, in an exemplary embodiment, the side wall 452 is provided with a rib 44 extending in the insertion direction, and the limiting protrusion 42 is disposed on the rib 44.

A positioning portion 41 extending in the insertion direction is provided on the side wall 452 of the receiving passage 45, in an exemplary embodiment, and is configured to guide the fixed arm 31 of the terminal 3 to insert into the receiving passage 45 and position the fixed arm 31 therein when the terminal 3 is pre-inserted into the housing 4. In this way, it is possible to prevent the pre-inserted terminal 3 from being detached from the housing 4 due to poor fixing thereof during the process of transferring the connector 200 from the production line to the automatic crimping apparatus.

A guiding slot 4511, extending in the insertion direction, is provided on the bottom wall 451 of the receiving passage 45, in an exemplary embodiment, so as to guide a protruding-downwardly portion 341 of the bottom wall 34 of the terminal 3. In this way, the protruding-downwardly portion is abutted against a protruding wall 4512 of the guiding slot 4511 when the terminal 3 is fully inserted into the receiving passage 45, so as to assist in positioning the terminal 3 therein.

As shown in FIGS. 5 and 6, in an exemplary embodiment, the terminal 3 further includes a release arm 33 extending obliquely upward from the bottom wall 34 of the terminal 3 in a direction opposite to the insertion direction, and having a rear end bent upward as a driving portion 331, which abuts against a portion of the housing 4 when the terminal 3 is fully inserted into the receiving passage 45. In a case where the mating terminal is inserted into the terminal 3, in order to release the mating terminal, the housing 4 is moved backward relative to the fully inserted terminal 3, and thus the driving portion 331 is depressed by the housing 4, so that the inserted mating terminal is allowed to be released from the terminal.

In an exemplary embodiment, the terminal 3 further includes: a fixing protrusion 36 formed on the release arm 33 and configured to be cooperated with a fixing hole (not shown) of the mating terminal when the mating terminal is inserted into the terminal 3, so as to lock the mating terminal lock between the body portion 32 and the fixed arm 31.

The housing 4, in an exemplary embodiment, further includes: a sloped wall 46, extending downward from the top wall 453 of the receiving passage 45, and is adapted to drive the driving portion 331 downward when the housing 4 moves rearward relative to the fully inserted terminal 3, so that the fixing protrusion 36 is disengaged from the fixing hole, thereby releasing the inserted mating terminal.

According to an exemplary embodiment, the housing 4 further includes: a blocking protrusion 43 formed at the front end of the housing 4, so as to prevent the terminal 3 from being inserted further when the terminal 3 is completely inserted the housing 1.

The terminal 3 further has a strip 37 located at a rear end of the crimping portion 35, through which a plurality of the terminals 3 may be successively connected in a row when the terminals 3 are processed.

During manufacturing of the connector, a row of the terminals 3 are first pre-inserted into the plurality of housings 4 respectively on the production line, so as to form a row of pre-inserted connectors 200 with the terminals 3; then the row of pre-inserted connectors 200 is installed in the automatic crimping device. The automatic crimping device is controlled to first crimp the wire into the crimping portion 35 of any one of the terminals 3, and then fully insert the terminal 3 crimped with the wire into the housing 4, so as to form the assembled connector 200. The strip 37 is cut off, therefrom, when the assembled connector 200 is used. This eliminates the steps of manual crimping of the wires and manual insertion of the connector 200, and the operation of assembling the connector 200 may be automatic, thereby reducing the assembly time and the labor cost associated with assembly of the connector.

It will be understood by those skilled in the art that the embodiments described above are exemplary and may be modified by those skilled in the art, and the structures described in the various embodiments may be combined freely without conflict in structure or principle thereof.

After explaining the embodiments of the present disclosure in detail, the person skilled in the art can distinctly may find out that various changes and modifications can be made without departing from the scope and spirit of the appended claims. The present disclosure is not limited to the embodiments of the exemplary embodiments set forth in the specification.

What is claimed is:

1. A connector comprising:

a housing having a receiving passage formed therein; and a terminal inserted in an insertion direction and mounted in the receiving passage, wherein a limiting protrusion is on a wall of the receiving passage, and configured to be abutted against the terminal retaining a portion of the terminal outside the receiving passage, when the terminal is pre-inserted into the receiving passage, and wherein the limiting protrusion is scraped off by the terminal to allow the terminal to be fully inserted and mounted in the receiving passage.

2. The connector according to claim 1, wherein, a guiding slot, extending in the insertion direction, is on a bottom wall of the receiving passage.

3. The connector according to claim 1, wherein, the terminal further comprises:

a body portion;

two fixed arm extending upward from two opposite sides of the body portion toward an upper side of the body portion to fix a mating terminal inserted from a front end of the terminal between the body portion and the fixed arms; and a crimping portion connected to a rear end of the body portion.

4. The connector according to claim 3, wherein, the crimping portion extends in a direction opposite to the insertion direction.

5. The connector according to claim 4, wherein, a rib extending in the insertion direction is on a side wall, and includes the limiting protrusion.

6. The connector according to claim 5, wherein, a positioning portion extending in the insertion direction is on the side wall of the receiving passage, and is configured to guide the fixed arms of the terminal so as to insert into the receiving passage and position the fixed arms when the terminal is pre-inserted into the housing.

7. The connector according to claim 3, wherein, the crimping portion extends outwards from a side of the body portion in a direction perpendicular to the insertion direction.

8. The connector according to claim 7, wherein, the housing is further formed with an auxiliary receiving portion extending outwards in the direction perpendicular to the insertion direction at a rear end of the receiving passage and is in communication with the receiving passage to receive the crimping portion of the terminal.

9. The connector according to claim 8, wherein, a positioning portion, extending in the insertion direction, is provided on a top wall of the receiving passage, and configured to guide the fixed arms of the terminal so as to insert into the receiving passage and position the fixed arms therein, when the terminal is pre-inserted into the housing.

10. The connector according to claim 9, wherein, the limiting protrusion is located on a bottom wall of the receiving passage.

11. A connector comprising:

a housing having a receiving passage formed therein; and a terminal inserted in an insertion direction and mounted in the receiving passage, comprising:

a body portion;

two fixed arm extending upward from two opposite sides of the body portion toward an upper side of the body portion to fix a mating terminal inserted from a front end of the terminal between the body portion and the fixed arms;

a crimping portion connected to a rear end of the body portion, wherein a limiting protrusion is on a wall of the receiving passage, and configured to be abutted against the terminal retaining a portion of the terminal outside the receiving passage, when the terminal is pre-inserted into the receiving passage; and a release arm extending obliquely upward from a bottom wall of the terminal in a direction opposite to the insertion direction, and having a rear end upwardly bent as a drive portion which is depressed by the housing to release the inserted mating terminal when the housing is moved rearward relative to the fully inserted terminal, wherein a limiting protrusion is on a wall of the receiving passage, and configured to be abutted against the terminal retaining a portion of the terminal outside the receiving passage, when the terminal is pre-inserted into the receiving passage.

12. The connector according to claim 11, wherein, the limiting protrusion is scraped off by the terminal so as to allow the terminal to be fully inserted and mounted in the receiving passage.

13. The connector according to claim 11, wherein, the terminal further comprises: a fixing protrusion formed on the release arm and configured to cooperate with a fixing hole of the mating terminal so as to lock the mating terminal between the body portion and the fixed arms.

14. The connector according to claim 13, wherein, the housing further comprises: a sloped wall extending downwardly from a top wall of the receiving passage and is configured to drive the drive portion downward when the housing moves rearwardly relative to the fully inserted terminal so as to disengage the fixing protrusion from the fixing hole and release the inserted mating terminal.

15. A connector housing comprising:

a receiving passage configured to receive a terminal inserted in an insertion direction and mounted therein, wherein a limiting protrusion is on a wall of the receiving passage, and configured to be abutted against the terminal when the terminal is pre-inserted into the connector housing so as to retain a portion of the terminal outside the connector housing, and the limiting protrusion is configured to be removed by the terminal so as to allow the terminal to be fully inserted and mounted in the receiving passage.

16. The connector housing according to claim 15, wherein, a positioning portion extending in the insertion direction is on the top wall of the receiving passage, and configured to guide the terminal to insert into the receiving passage and position the terminal therein when the terminal is pre-inserted into the connector housing.

17. The connector housing according to claim 15, further comprising an auxiliary receiving portion being in communication with the receiving passage so as to receive a crimping portion of the terminal.

18. The connector housing according to claim 15, wherein, a rib extending in the insertion direction is on a side wall, and is provided with the limiting protrusion.

19. A connector housing, comprising:

a receiving passage configured to receive a terminal inserted in an insertion direction and mounted therein; and an auxiliary receiving portion extending outwards in a direction perpendicular to the insertion direction at the rear end of the receiving passage and being in communication with the receiving passage to receive a crimping portion of the terminal, wherein a limiting protrusion is on a wall of the receiving passage, and configured to be abutted against the terminal when the terminal is pre-inserted into the connector housing so as to retain a portion of the terminal outside the connector housing.

20. The connector housing according to claim 19, wherein, the limiting protrusion is scraped off by the terminal so as to allow the terminal to be fully inserted and mounted in the receiving passage.

* * * * *